US009469995B2

(12) United States Patent
Viig et al.

(10) Patent No.: US 9,469,995 B2
(45) Date of Patent: Oct. 18, 2016

(54) ROOF WINDOW WITH A COVER AND A COVERING FASTENING DEVICE

(71) Applicant: VKR HOLDING A/S, Hørsholm (DK)

(72) Inventors: Martin Schwartz Viig, Viby J (DK); Atzen Bent, Horsens (DK)

(73) Assignee: VKR HOLDING A/S, Horsholm (DK)

( * ) Notice: Subject to any disclaimer, the term of this patent is extended or adjusted under 35 U.S.C. 154(b) by 0 days.

(21) Appl. No.: 14/349,622

(22) PCT Filed: Oct. 4, 2012

(86) PCT No.: PCT/DK2012/050375

§ 371 (c)(1),
(2) Date: Apr. 3, 2014

(87) PCT Pub. No.: WO2013/050043

PCT Pub. Date: Apr. 11, 2013

(65) Prior Publication Data

US 2014/0366452 A1 Dec. 18, 2014

(30) Foreign Application Priority Data

Oct. 4, 2011 (DK) ..... 2011 70548

(51) Int. Cl.
*E04D 13/035* (2006.01)

(52) U.S. Cl.
CPC ..... *E04D 13/0354* (2013.01)

(58) Field of Classification Search
CPC . E04D 13/0354; E04D 13/03; E04D 13/035; Y10T 403/60; Y10T 403/7039; Y10T 24/30; Y10T 24/309; Y10T 24/44026; Y10T 24/45105
See application file for complete search history.

(56) References Cited

U.S. PATENT DOCUMENTS

| | | | | |
|---|---|---|---|---|
| 2006/0157890 | A1* | 7/2006 | Amano et al. | 264/252 |
| 2008/0120930 | A1* | 5/2008 | Jacobsen | 52/204.55 |
| 2009/0277111 | A1* | 11/2009 | Albrecht et al. | 52/213 |

FOREIGN PATENT DOCUMENTS

| | | | |
|---|---|---|---|
| DE | 2 000 450 | * | 1/1970 |
| DE | 8815464 | U1 | 4/1990 |
| DK | 2006002633 | A1 | 12/2006 |
| EP | 392342 | A2 | 10/1990 |
| EP | 1243738 | A2 | 9/2002 |
| EP | 1355016 | A2 | 10/2003 |
| EP | 1 681 399 | * | 7/2006 |
| EP | 1 873 016 | A1 * | 1/2008 |
| EP | 2 426 305 | * | 3/2012 |

* cited by examiner

*Primary Examiner* — Gregory Strimbu
(74) *Attorney, Agent, or Firm* — Timothy D. St. Clair; Nexsen Pruet, LLC

(57) ABSTRACT

A roof window (1) comprising a frame (2) with a top member (5), a bottom member (6) and two side members (7, 8) defining a frame plane, and a sash (3) having a top member (9), a bottom member (10) and two side members (11, 12) defining a sash plane, the sash (3) being connected to the frame (2) by a pivot hinge (200) provided between the side members (7, 11; 8, 12) of the frame (2) and sash (3). The roof window (1) further comprising a covering (217, 201) and at least one fastening device (208, 209) for fastening the covering (217, 201) to the roof window (1). The at least one fastening device comprises a male part (208) and a female part (209) arranged with the male part (208) on the covering (217, 201) and the female part (209) on the frame (2) or sash (3) and adapted for mutual snap locking engagement.

15 Claims, 12 Drawing Sheets

ROOF WINDOW WITH A COVER AND A COVERING FASTENING DEVICE

BACKGROUND OF THE INVENTION

In known roof windows of this kind the fastening device is provided as one or more screws that are screwed through the covering and into the underlying window structure, i.e. either the frame or the sash.

This has worked very well for decades, but in view of the ever increasing demand on the windows, such as ease of mounting, longer lifetime, easier maintenance and improved insulating properties, it is the object of the invention to provide a window with an alternative fastening of the covering.

BRIEF SUMMARY OF THE INVENTION

The present invention relates to a roof window comprising a frame with a top member, a bottom member and two side members defining a frame plane, and a sash having a top member, a bottom member and two side members defining a sash plane, the sash being connected to the frame by a pivot hinge provided between the side members of the frame and sash, respectively, the roof window further comprising a covering and at least one fastening device for fastening the covering to the roof window.

This and other objects are achieved with a roof window of the above kind, where the at least one fastening device comprises a male and a female part arranged one on the covering and the other on the roof window and adapted for mutual snap locking engagement.

The snap locking engagement means that the covering is remarkably simple to mount on the window structure and to loosen there from, thus leading not only to easy mounting of the window, but also allowing easy removal of the covering. This not only enables replacement of the covering, for example if wishing to change the physical appearance of the window, but also allows for inspection and maintenance of other parts of the window underneath the covering. Another advantage is that neither the covering nor the frame or sash member to which it is attached necessarily has to be penetrated by the fastening device, thus minimizing the risk of moisture penetrating into the window structure, which has been known to lead to deterioration, particularly the formation of rot and mould on wooden frames and sashes. Furthermore, the risk of corrosion on the covering at the fastening device is minimized. A still further advantage is, that the direct metal connection between the covering and the frame or sash previously formed by the screws is no longer present, hence eliminating a thermal bridge.

Preferably, one of the male and female parts is arranged on the covering, while the other one is arranged on another part of the roof window preferably on the pivot hinge and/or the frame and/or the sash of the roof window. Still more preferred the male part is arranged on the covering, since this allows for a simple mounting process.

In a very reliable embodiment, where the risk of erroneous mounting is minimized and the stability of the connection maximized, the male part of the fastening device comprises a first leg and a second leg adapted to engage with an opening of the female part such as to provide a snap-locking connection. A one-legged embodiment, however, may also be preferred due to its structural simplicity.

One or two legs of the male part may be flexible, allowing them to bend perpendicularly to their longitudinal extension, and/or may be provided with barb-like protrusions intended for engagement with shoulders or edges on the female part.

The covering may for example be a frame striking bead covering or a sash striking bead covering and when applying the invention on a centre-hung window it is preferred that both of these coverings are attached according to the invention, either to the frame or sash, respectively, or to the respective hinge parts.

In a preferred embodiment, the male part of the fastening device is integrally formed in the covering to minimize the number of components required. Likewise the female part may be integrated in the window hinge.

Preferred embodiments and further advantages will be apparent from the following detailed description and the appended dependent claims.

DESCRIPTION OF THE DRAWINGS

The invention will be explained in more detail below by means of non-limiting examples and with reference to the schematic drawing, in which.

DETAILED DESCRIPTION OF THE INVENTION

Figure 1:
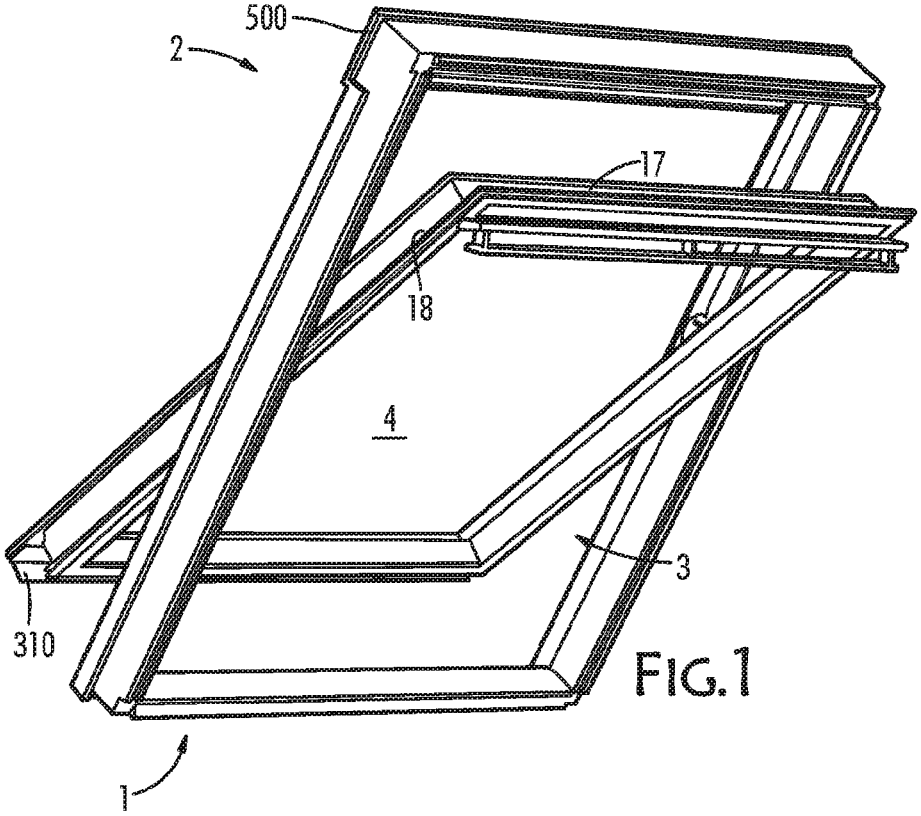
FIG. 1 shows a perspective view of a window according to the invention in the assembled state seen from the interior.
Figure 2:
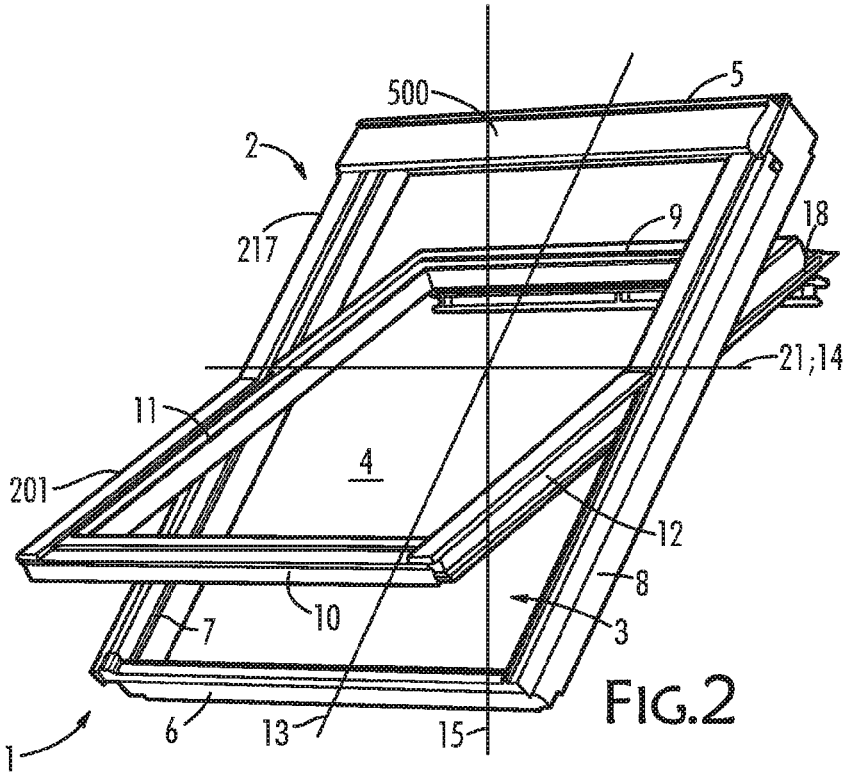
FIG. 2 shows a perspective view of a window according to the invention in the assembled state seen from the exterior.

FIGS. 1 and 2 show a preferred embodiment of a window 1 according to the invention comprising a pane 4 defining plane 16, a frame 2 having a top member 5, a bottom member 6 and two side members 7, 8 defining a frame plane, and a sash 3 having a top member 9, a bottom member 10 and two side members 11, 12 defining a sash plane. In the embodiment shown, the window is centre-hung in that the sash 3 is connected to the frame 2 by a pivot hinge (200 on FIGS. 9 and 10) provided between side members 7, 11; 8, 12 of the frame 2 and sash 3, respectively, to be openable by tilting the sash 3 of the window 1 about the pivot hinge axis 21 defined by the pivot hinge 200. The pivot hinge 200 comprises two parts, namely a sash part 19 and a frame part 20.

The hinges used are preferably of the type described in the applicant's earlier patent applications WO9928581 and GB1028251, where a curved member and a tap on one hinge part travels in a curved guide track in the other during opening and closing of the window. The radius of curvature entails that when using such hinges, the hinge axis lies at a small distance above the actual hinge parts and as the sash frame is turned first the curved member and then the tap comes out of the track. In combination this provides a pattern of movement which allows easy operation of a centre-hung window and allows the sash frame to be turned substantially entirely around.

As used in this description, a closed position of the window 1 means a position in which the frame plane and the sash plane coincide, that is form an angle of 0 degrees with each other. Similarly an open position of the window 1 as used herein generally means a position in which the sash 3 is tilted about the pivot hinge axis 21 such that the frame plane and the sash plane no longer coincide.

As seen in FIG. 1 a longitudinal axis 13 of the window 1 is defined as extending perpendicular to and between the frame top member 5 and the frame bottom member 6, a transversal axis 14 of the window is defined as extending perpendicular to and between the respective frame side members 7 and 8 and thereby perpendicular to the longitudinal axis 13 and a depth axis 15 of the window 1 is defined as extending perpendicular to both the longitudinal axis 13 and the transversal axis 14. The pivot hinge axis 21 and the transversal axis 14 are parallel, and are shown as coinciding in the figures.

The window 1 furthermore comprises a lock 17 of a type known per se for locking the frame 2 and sash 3 to each other as well as a generally circumferentially extending sealing 18 provided on the sash 3 for sealing the gap between the sash 3 and the frame 2 in the closed position of the window 1. The sealing 18 comprises at least one, preferably at least two sealing strips.

Notwithstanding the centre-hung window 1 shown in FIG. 1 the window according to the invention may in other embodiments be top-hung, with or without an intermediate frame structure, have the hinge axis somewhere between the top and the centre, be side-hung or for that matter even be bottom-hung.

The sash 3 and frame 2 of the window according to the invention may for example be made of wooden members or cast or extruded members of polyurethane (PUR).

The window 1 furthermore comprises a sash striking bead covering 201 as well as a frame striking bead covering 217. The sash striking bead covering 201 as well as the frame striking bead covering 217 is provided with a male part 208 of a snap lock fastening device for fastening the sash or frame striking bead covering 201 or 217 to the sash 3 or the frame 2, respectively, as illustrated for the frame striking bead covering in FIGS. 3-5.

In the following, the male part 208 of the snap lock fastening device will be described with reference to the frame striking bead covering 217, but it is understood that the male part of the snap lock fastening device on the sash striking bead covering 201 is similar. Likewise it is to be understood that the male part 208 may be arranged on the window structure, e.g. on the pivot hinge, and the female part 209 on the covering.

The male part 208 in FIGS. 3-9 comprises a first leg 210 and a second leg 211, both of which extend from underneath and substantially perpendicular to the mid portion 218 of the frame striking bead covering 217. The first leg 210 is shorter than the second leg 211, here approximately half as long, and preferably approximately ¼-¾ of the length of the second leg 211.

Figure 4:
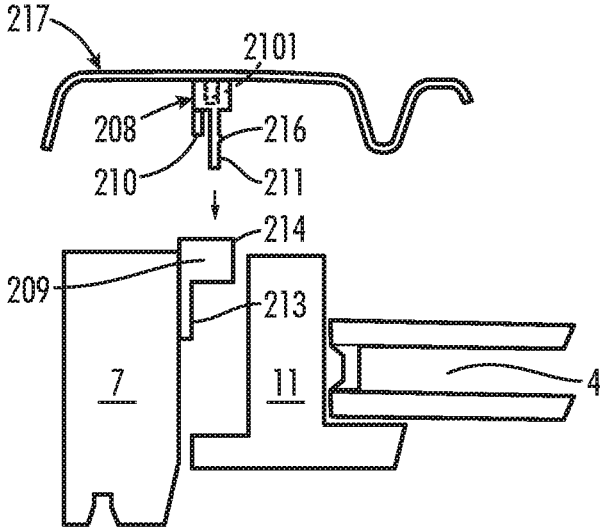
FIG. 4 shows a step of a process for mounting a frame striking bead covering on a window according to the invention using of a snap lock fastening device according to the invention.
Figure 5:
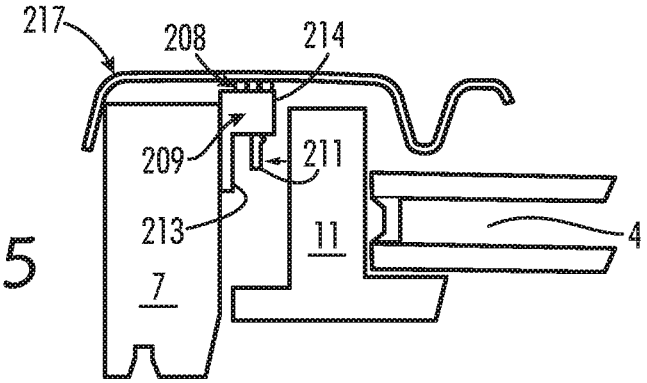
FIG. 5 shows a step of a process for mounting a frame striking bead covering on a window according to the invention using of a snap lock fastening device according to the invention.
Figure 6:
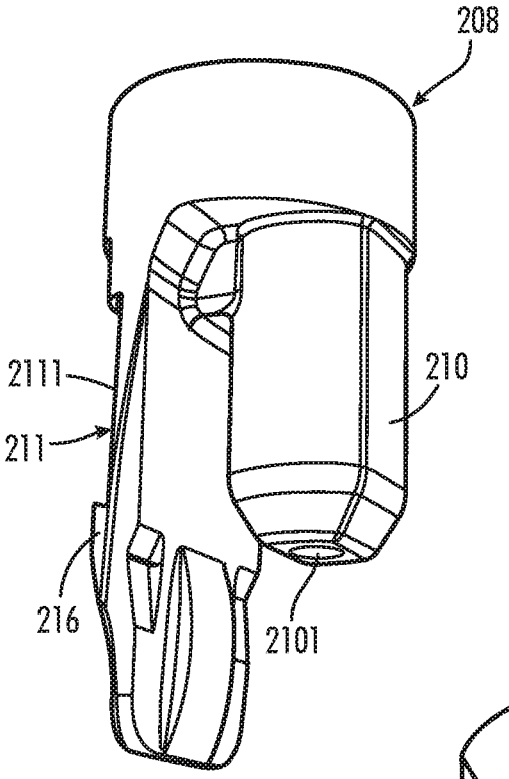
FIG. 6 is a perspective view of a male part for a snap lock fastening device suitable for use in the process illustrated in FIGS. 3-5.

The first leg 210 of the male part 208 is of a thickness that allows it to receive a fastener 212, such as a rivet, pin, spike or screw, projecting from the frame striking bead covering 217. In FIGS. 3-7 the male part is illustrated with an opening having substantially the same shape as the fastener 212, but it is also possible to simply force the fastener into the material of a substantially massive first leg. In FIG. 6 the opening goes all the way through the first leg. This has two advantages: Firstly, the pointed end of a screw used as a fastener may penetrate through the opening and, secondly and more importantly, the insertion of the fastener will not be hinder by an air pressure building up inside the first leg.

Figure 7:
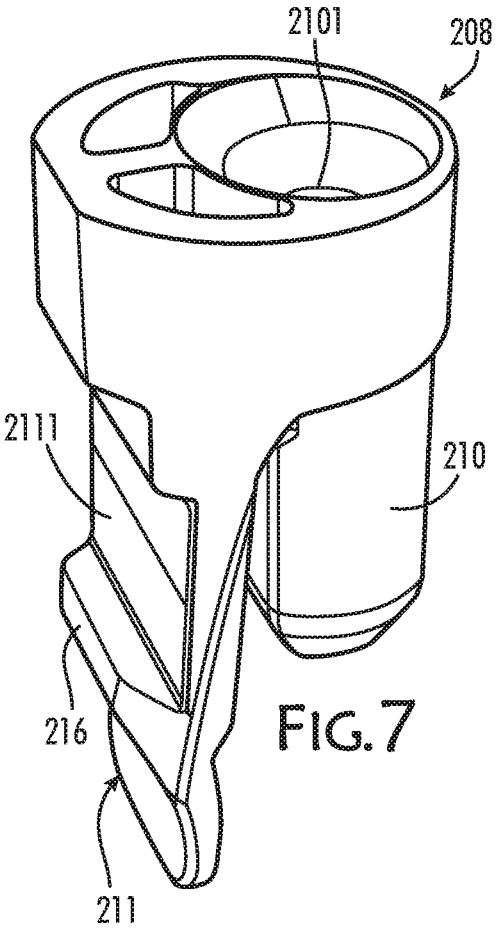
FIG. 7 is a perspective view of a male part for a snap lock fastening device suitable for use in the process illustrated in FIGS. 3-5.

The second leg 211 in FIGS. 3-9 is flexible along a direction 283 perpendicular to its own longitudinal extension and towards and away from the first leg 210 achieved in the embodiment shown in FIGS. 6 and 7 by the provision of a relatively weak section 2111, where the leg will easily bend. A protrusion 216 is provided on a face of the second leg 211 that faces away from the first leg 210.

Figure 3:
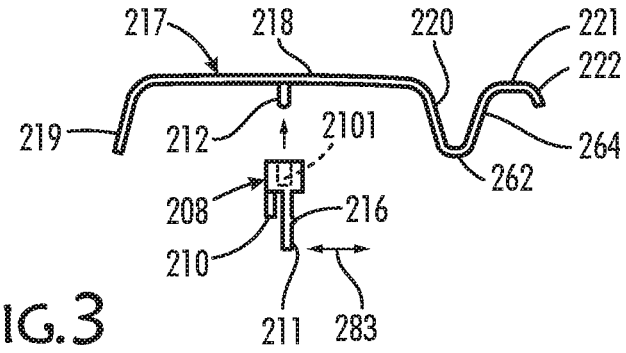
FIG. 3 shows a step of a process for mounting a frame striking bead covering on a window according to the invention using of a snap lock fastening device according to the invention.

The male part 208 is adapted to engage in a snap-locking way with a female part 209 of the snap lock fastening device. In FIGS. 3-5 a female part 209 is shown only on the frame member 7, but it is to be understood that a corresponding female part is preferably also provided on the sash member 11 for attachment of the sash striking bead covering 201.

Figure 8:
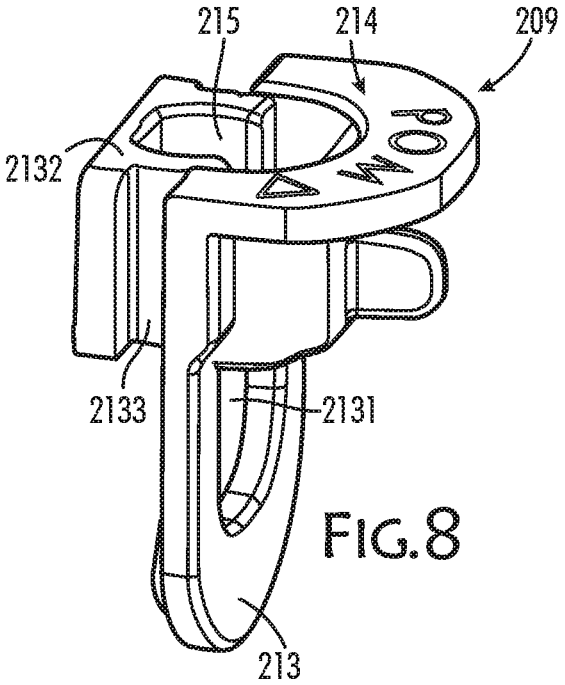
FIG. 8 is a perspective view of a female part for use with the male part illustrated in FIGS. 6 and 7.

One embodiment of a female part 209 adapted for engagement with the male part shown in FIGS. 6 and 7 is shown in FIG. 8.

Figure 9:
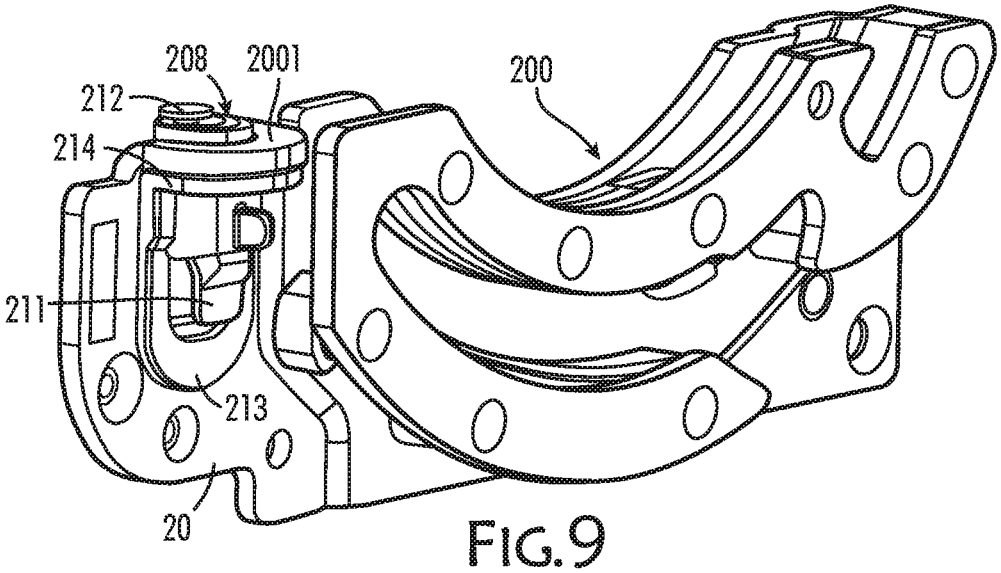
FIG. 9 shows a pivot hinge with a fastening device according to the invention including the male part illustrated in FIGS. 6 and 7 and the female part shown in FIG. 8.
Figure 10A:
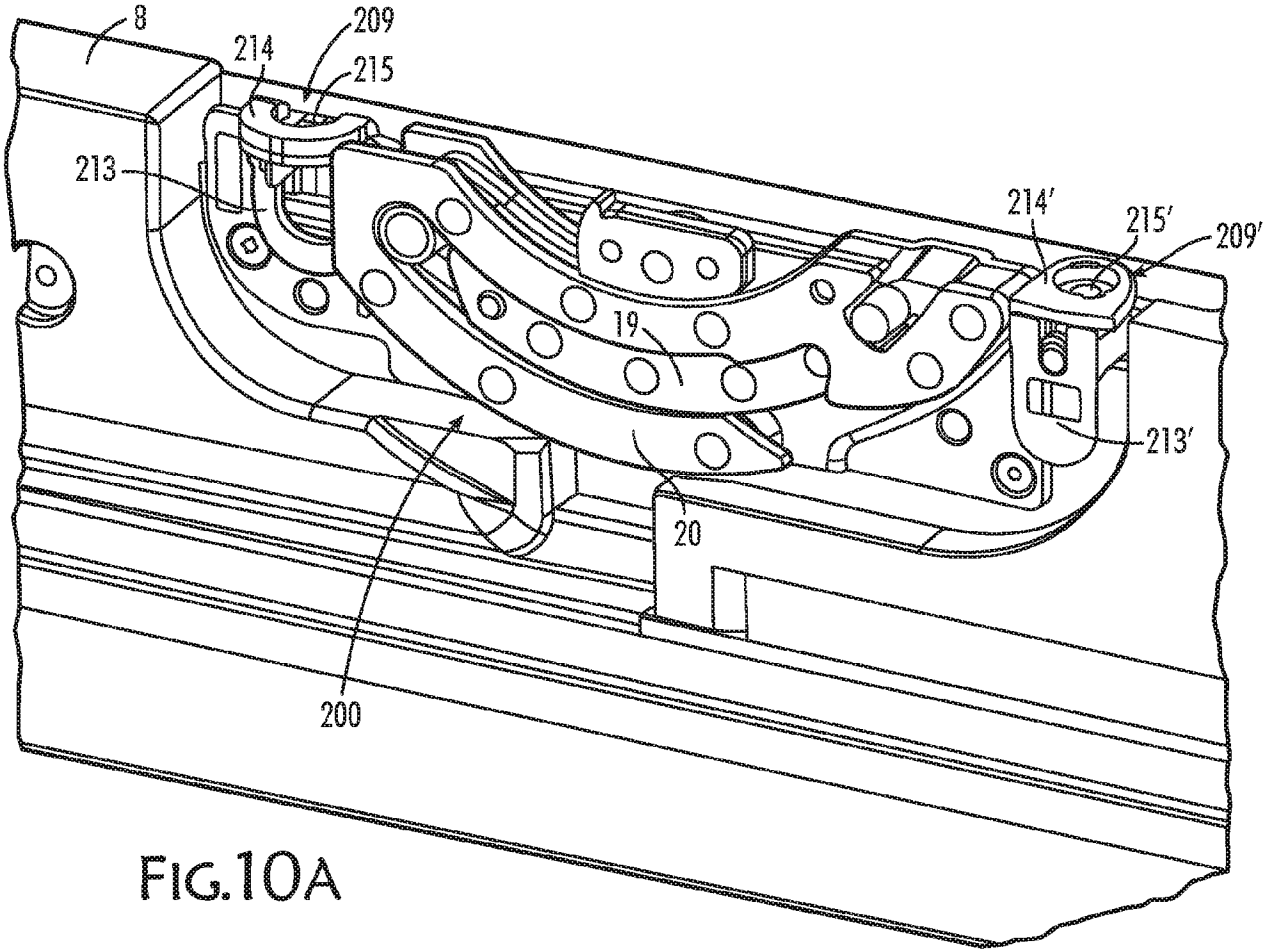
FIG. 10*a* shows a perspective partially cut-away view of a side member of a stationary frame where female parts of a snap lock fastening device according to the invention have been attached to both hinge parts of a pivot hinge.
Figure 10B:
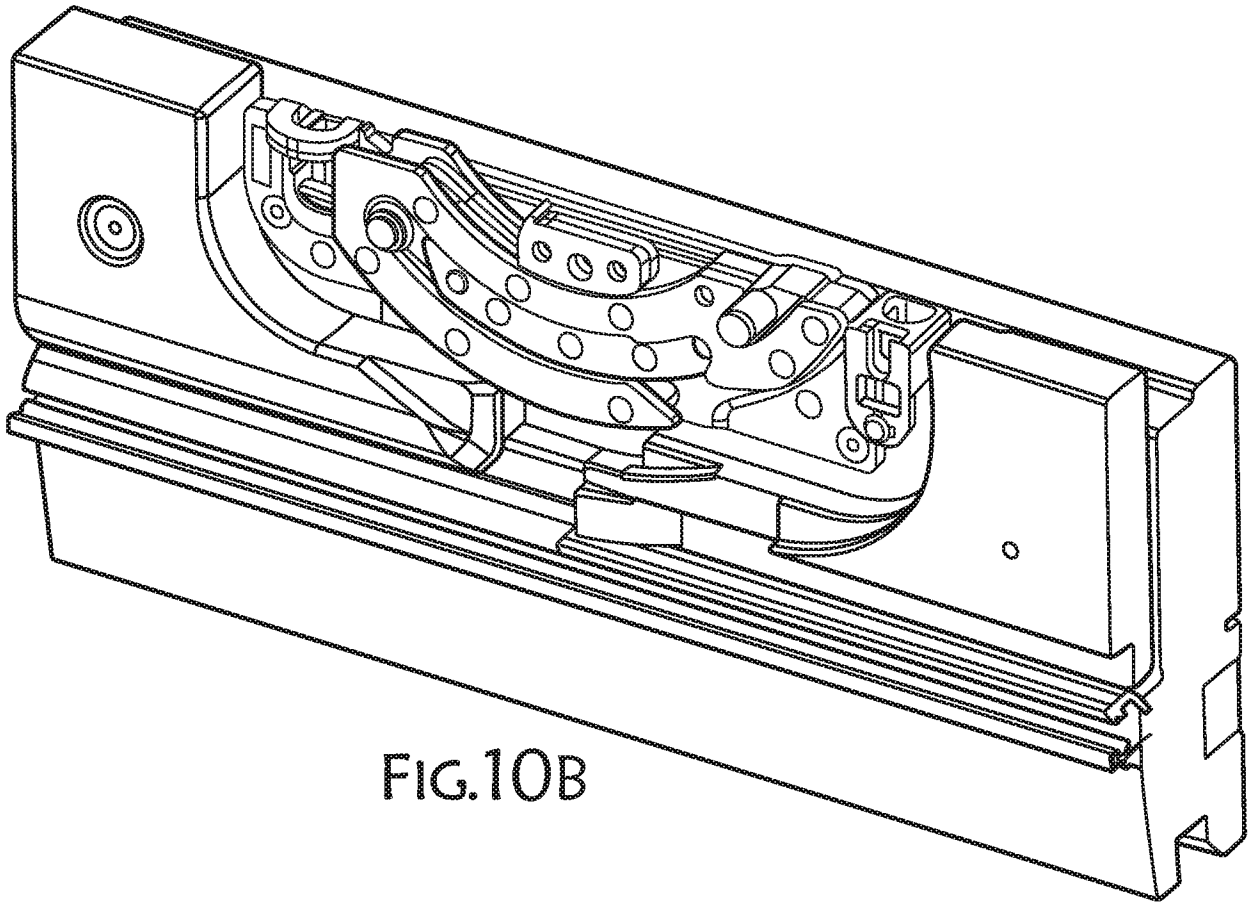
FIG. 10*b* shows a perspective partially cut-away view of a side member of a stationary frame where female parts of a snap lock fastening device according to the invention have been attached to both hinge parts of a pivot hinge.

In the embodiment shown in FIGS. 3-5, the female part 209 that is adapted to receive a male part 208 provided on the frame striking bead covering 217 is fastened to the window frame 7, whereas in FIGS. 9 and 10 it is fastened to the frame part 20 of the pivot hinge. Likewise, a female part 209' adapted to receive a male part that is provided on the sash striking bead covering 201 is fastened to the sash part 19 of the pivot hinge 200 in FIGS. 1Oa and 1Ob. It is to be understood that the female parts 209 and 209' do not necessarily have to be fastened to the respective parts of the pivot hinge. It is envisaged that one or both of the female parts are fastened directly to the side sash member 11 and side frame member 7, respectively, as shown in FIGS. 3-5 for the frame member 7. Moreover, it is to be understood that the fastening devices used on the sash and frame need not be identical or even of the same type.

The female parts 209, 209' of the snap lock fastening device shown in FIGS. 4, 9 and 10 have the general shape of an angle bracket. A first leg 213, 213' thereof is fastened to a hinge part 19, 20 or side member 7, 11. It is noted that for the sake of clarity the part of the hinge part 19 to which the first leg 213' of the female part 209' is attached is not shown in FIGS. 1Oa and 1Ob. A second leg 214, 214' thereof is provided with an opening 215, 215' configured to receive the male part 208. The hinge parts 19, 20 of the pivot hinge 200 may have elements that assist in forming the female parts 209, 209' of the snap lock fastening device; here in the form of a flange 2001 having substantially the same shape as the second leg 214 of the female part 209. The attachment of the female part to the hinge part 20 is here achieved by inserting the projecting part 2132 into a slot in the hinge member so that material of the hinge member projects into the grooves 2133 on either side of the projection.

The female parts 209, 209' of the snap lock fastening device may alternatively be integrally formed in the hinge parts, for example by material of the hinge being pressed to shape to form a female part.

The shape of the opening 215, 215' is substantially such that the male part 208 is retained in the female part 209, 209' once inserted. To this end in the embodiment in FIGS. 3-10, the second leg 211 is forced aside during insertion and when in place the protrusion 216 of the second leg 211 snaps into the opening 2131 in the first leg 213 of the female part 209 and thus results in a snap locking effect being obtained.

To release the male part 208 from its snap lock engagement with the female part 209, 209', the second leg 211 of the male part 208 is pressed towards the first leg 210 of the male part 208 until the protrusion 216 on the second leg 211 can pass through the opening 215, 215' together with the rest of the male part 208. Now, the male part 208 can be retracted from the female part 209, 209'. The part of the second leg, which must be pressed on to release the fastening device, may be marked, for example by having a different colour than the female part.

Using a fastener, which is e.g. welded to the interior side of the covering or otherwise integrated therein, has several advantages over the prior art fastening by the aid of screws, since the fastening device are fastened to the striking bead coverings and does not get lost as easily as screws. Also, there are no through holes in the striking bead coverings for insertion of mounting screws. Hence, the risk of water intrusion into the frame and sash structure is reduced. Also, a nicer and more homogeneous appearance is obtained. Furthermore, this embodiment provides for a safer mounting in relation to break-ins, as there are no screws that are accessible from the outside. Furthermore, the snap lock engagement can only be released from the inside of a building in which the window 1 is mounted, as the protrusion 216 on the second leg 211 of the male part 208 has to be activated from inside in order to release the engagement.

The use of screws as fasteners, however, provides a reliable and durable connection, which may in some circumstances outweigh the advantages mentioned above. As opposed to the prior art solution these screws do not penetrate into the window structure, only into the male parts of the fastening devices.

In an alternative embodiment, which combines the advantages of the solutions mentioned above, the fastener penetrates through an opening in the covering, but has no slot or the like allowing removal from the outside. This may for example be achieved by making the fastener from a material, which is relatively soft or can be softened e.g. by heating, and then flattening this material on the exterior side of the covering, thereby forming a permanent connection.

Both the male part 208 and female part 209 of the snap lock fastening device is preferably made of a polymer or a thermoplastic, preferably polyoxymethylene (POM). Using a polymer or a thermoplastic is beneficial, as it has poor heat conductive properties. Hence, the risk of forming a thermal bridge is reduced. Furthermore, POM has sufficiently high tensile strength to provide a secure and robust fastening of striking bead coverings.

It is envisaged, however, that the male and female part of the snap lock fastening device can be made of any suitable material with a sufficiently high tensile strength. For instance, the male part of the snap lock fastening device may be in the form of a leaf spring made from a suitably flexible and strong metal or alloy or combination thereof. The female part may be made of any material adapted to suitably mate the leaf spring material so as to be durable and avoid the formation of a thermal bridge.

Figure 11:
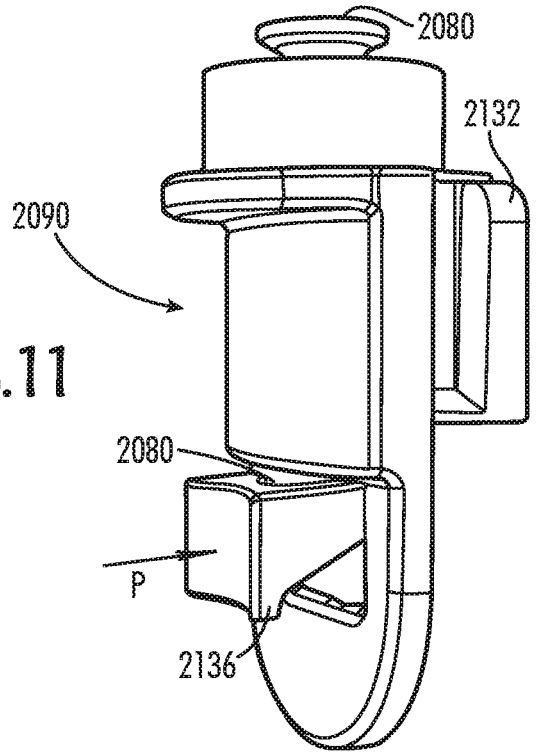
FIG. 11 shows an alternative fastening device for fastening a frame striking bead covering.
Figure 12:
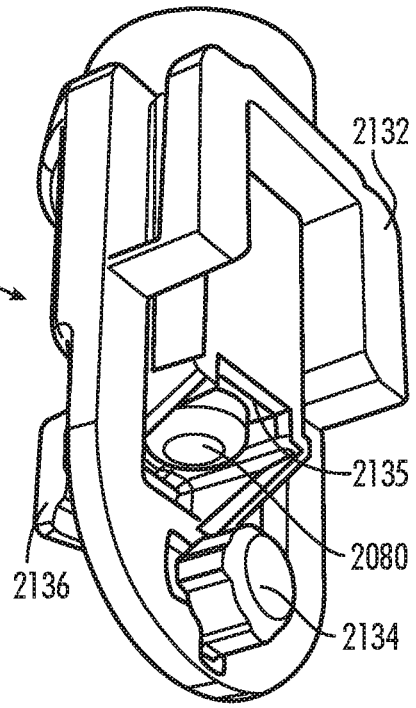
FIG. 12 shows the fastening device in FIG. 11 from a different angle.
Figure 13:
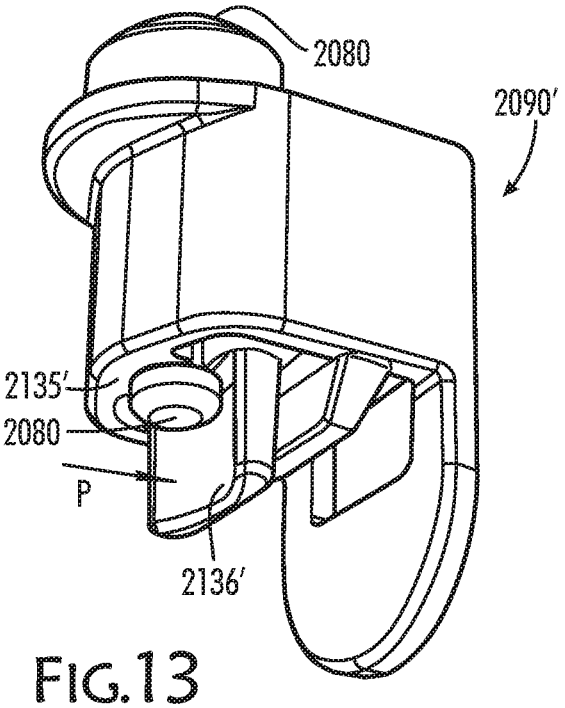
FIG. 13 shows an alternative fastening device for fastening a sash striking bead covering.
Figure 14:
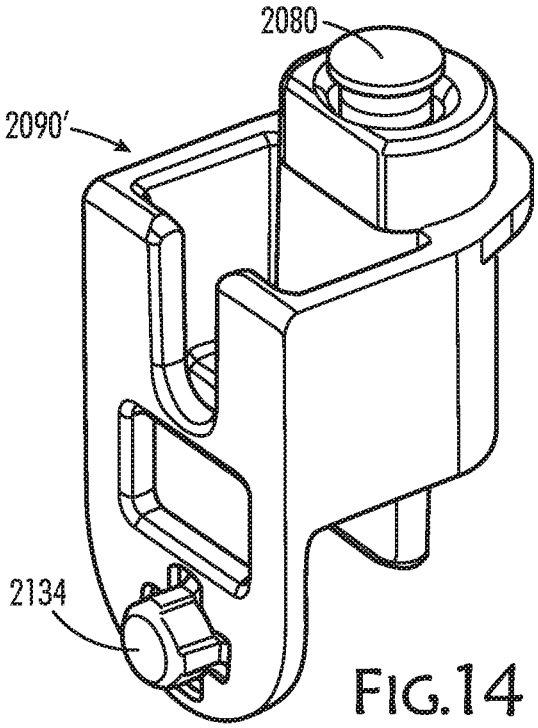
FIG. 14 shows the fastening device in FIG. 13 from a different angle.

Yet another alternative embodiment, where the fastener also serves as the male part, is shown in FIGS. 11-15; FIGS. 11 and 12 illustrating the fastening devices intended for the frame and FIGS. 13 and 14 illustrating the fastening device intended for the sash. The male part 2080 is shown alone in FIG. 15.

The female parts in FIGS. 11-15 are intended for mounting on the hinge frame parts in the same way as in FIGS. 9 and 10 and thus have similar means for interconnection to the hinge part. As an example the female part 2090 in FIGS. 11-12 has a projecting part 2132 corresponding to that described with reference to FIG. 8 and both female parts 2090, 2090' have mounting pins 2134 intended for projecting into holes in the respective hinge parts.

Figure 15:
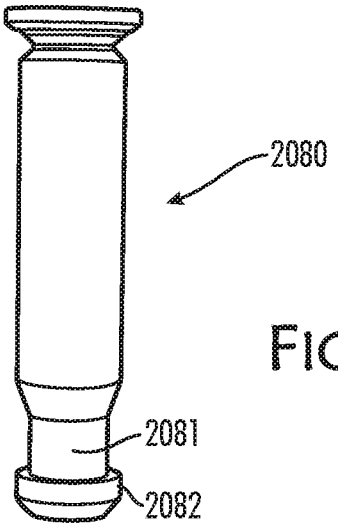
FIG. 15 shows the male part used in FIGS. 11-14 in a perspective view.

As may be seen in FIG. 15 the male part 2080, which is here of a substantially circular cross-sectional shape, has a section 2081 of a decreased thickness forming a head 2082 at the distal end, furthest from the covering (not shown). This head has the same function as the protrusion 216 on the second leg 211 in the embodiment in FIGS. 6 and 7 and comes into a snap locking engagement with a locking flange 2135, 3135' on the respective female part as is seen most clearly in FIGS. 12 and 13. Release mechanisms are provided in the form of release projections 2136, 2136', which are inter-connected to the locking flanges; these are moved away from the male part when a pressure is applied to the release projections as indicated by the arrows P in FIGS. 11 and 13. The release mechanism is thus associated with the female part in this embodiment, whereas it is associated with the male part in the embodiment described with reference to FIGS. 3-9.

Figure 16:
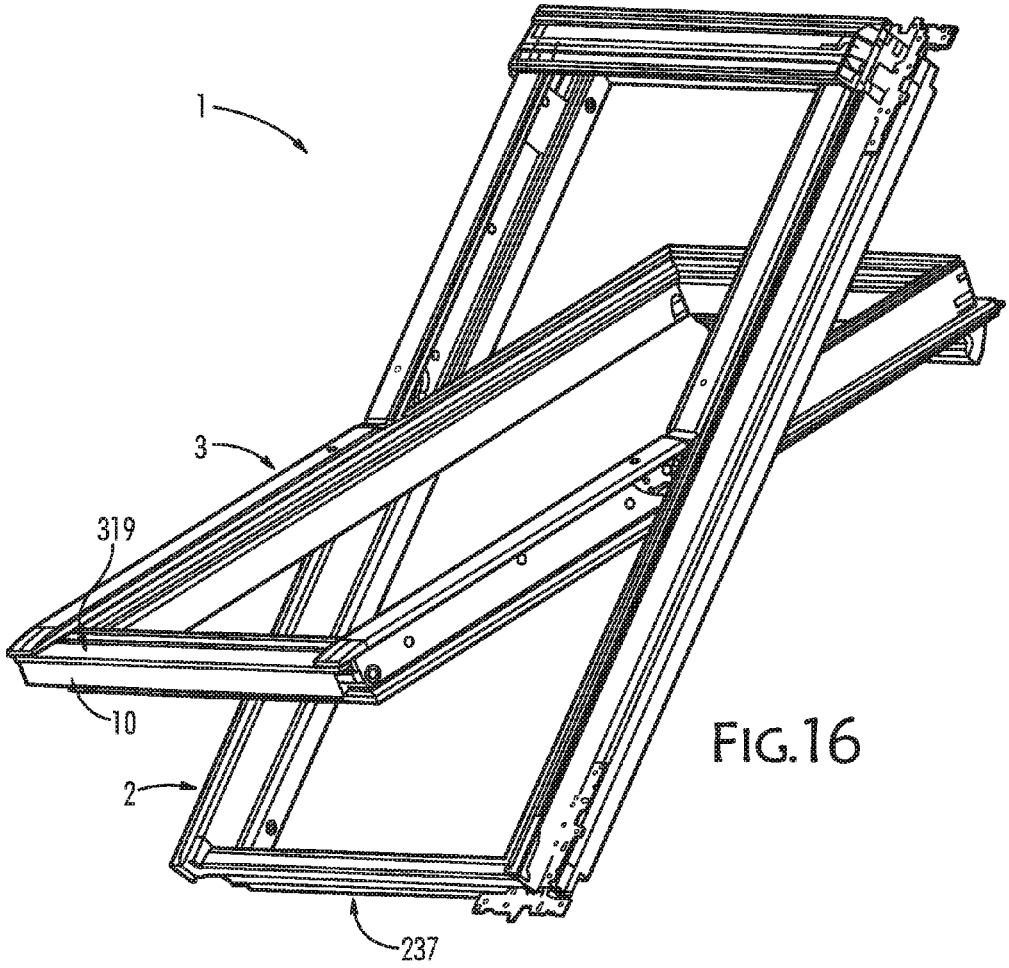
FIG. 16 and FIG. 17 show a roof window according to the invention from two different angles.
Figure 17:
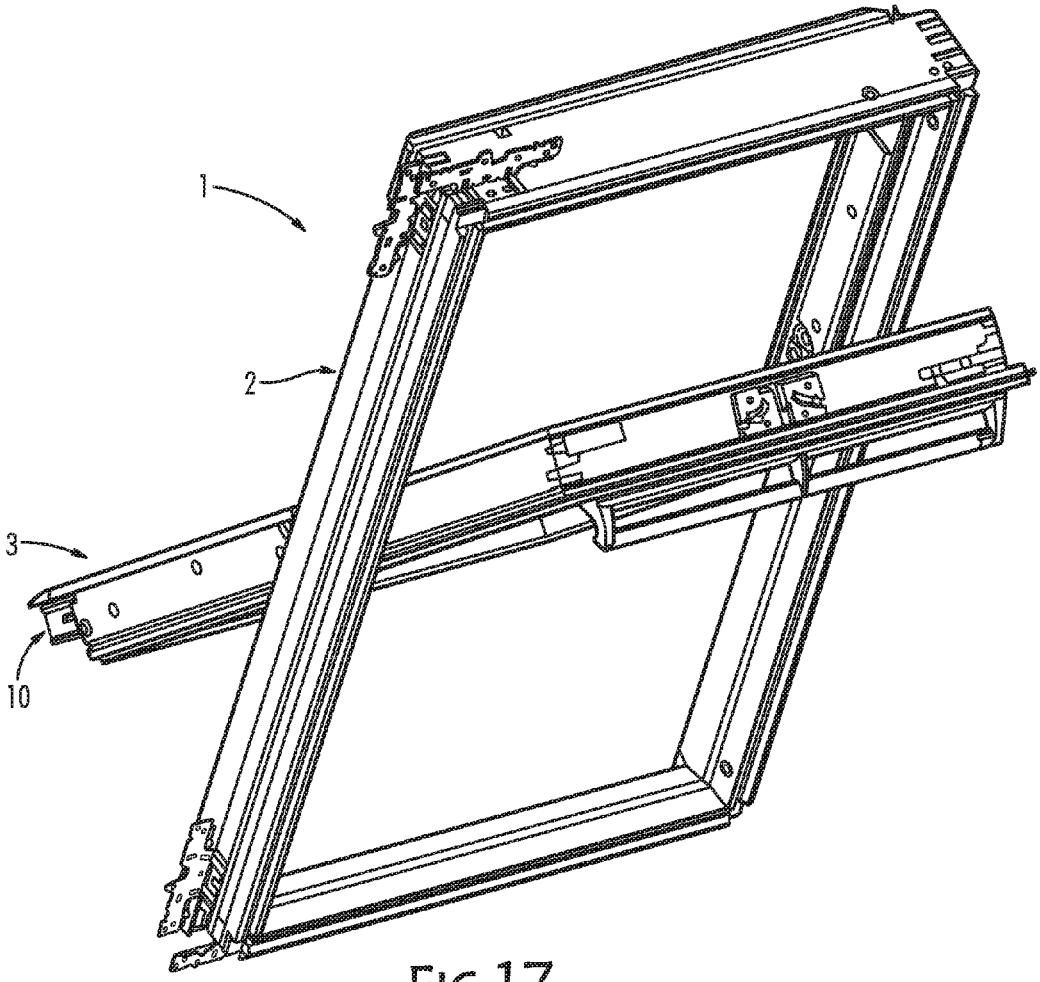
Figure 18:
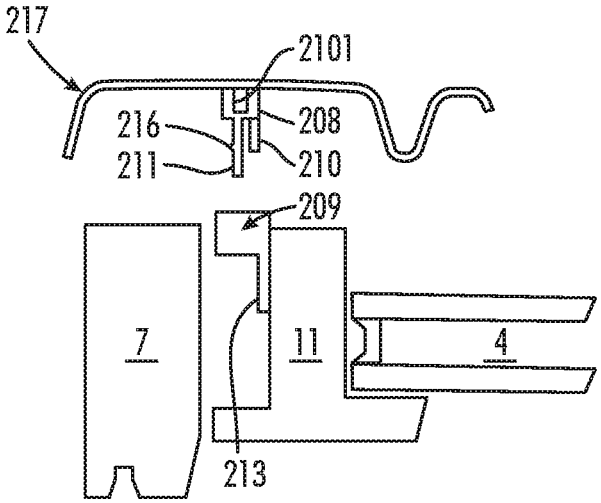
FIG. 18 shows a second part of the fastening device integral with the sash, according to the invention.

A window according to the invention is shown in an open state from two different angles in FIGS. 16 and 17.

It is noted that the above description of preferred embodiments serves only as an example, and that a person skilled in the art will know that numerous variations are possible without deviating from the scope of the claims.

The invention claimed is:

1. A roof window, comprising:

a window structure comprising a frame and a sash, the frame including a top frame member, a bottom frame member, and first and second side frame members, and a sash having the top sash member, a bottom sash member and first and second side sash members, the sash connected to the frame by a pivot hinge, the frame and the sash defining a gap therebetween when the sash is in a closed position relative to the frame, a covering, the covering extending over the gap when the sash is in the closed position, and a fastening device for releasably fastening the covering to the window structure, the fastening device comprising a first part, having first and second legs, and a second part, the first part configured for snap-locking engagement with the second part, wherein the first part is disposed on one of the covering and the window structure, and wherein the second part is disposed on the other of the covering and the window structure, the second part being an L-shaped bracket and including a first leg adapted for fastening to the pivot hinge, one of the side frame members or one of the side sash members and a second leg provided with an opening configured to receive the legs of the first part of the fastening device, and wherein the second leg of the first part has a protrusion extending therefrom which extends beyond the second leg of the L-shaped bracket when the first and second parts of the fastening device are snap-locked together, and a portion of the second leg of the first part extends longitudinally beyond the protrusion and the second leg of the L-shaped bracket when the first and second parts of the fastening device are snap-locked together and is engageable so as to be moveable toward the first leg of the L-shaped bracket to release the snap-locking engagement and enable the covering to be removed from the window structure.

2. A roof window according to claim 1, wherein the frame defines a first plane.

3. A roof window according to claim 2, wherein the sash defines a second plane.

4. A roof window according to claim 1, characterized in that the second part of the fastening device is integral with the pivot hinge, the one of the side frame members, or the one of the side sash members.

5. A roof window according to claim 1, wherein the covering is a frame striking bead covering.

6. A roof window according to claim 1, characterized in that at least one of the first and second parts of the fastening device is made of a polymer.

7. A roof window according to claim 6, wherein said polymer is a thermoplastic.

8. A roof window according to claim 7, wherein said thermoplastic is polyoxymethylene.

9. A roof window according to claim 1, wherein the first part of the fastening device is disposed on the covering.

10. A roof window according to claim 1, wherein the first part the fastening device is configured to be releasable from the second part of the fastening device by flexing the second leg of the first part in a direction perpendicular to longitudinal axis of the second leg.

11. A roof window according to claim 1, wherein the protrusion is provided on a face of the second leg of the first part that faces away from the first leg of the first part.

12. A roof window according to claim 1, wherein the first leg of the first part is shorter than the second leg of the first part and defines a length approximately ¼ to approximately ¾ of a length of the second leg of the first part.

13. A roof window according to claim 1, wherein the first and second legs of the first part of the fastening device both extend substantially perpendicular to a portion of the covering.

14. A roof window according to claim 1, wherein the first part of the fastening device is integral with the covering.

15. A roof window according to claim 1, wherein the covering is a sash striking bead covering.

* * * * *